US005169043A

United States Patent [19]

Catania

[11] Patent Number: 5,169,043

[45] Date of Patent: Dec. 8, 1992

[54] VERSATILE CARRYING BAG

[76] Inventor: Claude L. Catania, 11212 Lazy Lake Dr., Baton Rouge, La. 70818

[21] Appl. No.: 626,748

[22] Filed: Dec. 12, 1990

[51] Int. Cl.[5] ..... A45F 3/00

[52] U.S. Cl. ..... 224/224; 224/228

[58] Field of Search ..... 224/224, 228, 253, 227, 224/229; 383/87

[56] References Cited

U.S. PATENT DOCUMENTS

| | | | |
|---|---|---|---|
| 985,499 | 2/1911 | Batchelder | 224/227 |
| 1,173,125 | 2/1916 | Seidel | 224/227 |
| 1,338,776 | 5/1920 | Jennings | 224/227 |
| 1,339,795 | 11/1920 | Spalding | 224/228 |
| 2,397,200 | 3/1946 | Perry | 224/253 |
| 2,682,981 | 7/1954 | Previdi | 224/253 |
| 2,710,639 | 6/1955 | Farls | 383/26 |
| 2,842,179 | 7/1958 | Hoeppner | 383/87 |
| 3,510,052 | 5/1970 | Ruda | 383/87 |
| 3,722,785 | 3/1973 | Rivman | 383/87 |
| 3,949,916 | 4/1976 | Yount | 224/240 |
| 4,119,249 | 10/1978 | Hanson | 224/253 |
| 4,545,414 | 10/1985 | Baum | 224/224 |
| 4,893,739 | 1/1990 | Conner | 224/240 |
| 5,040,711 | 8/1991 | Niederhauser | 224/228 |

FOREIGN PATENT DOCUMENTS

| | | | |
|---|---|---|---|
| 44466 | 10/1927 | Norway . | |
| 58337 | 8/1937 | Norway | 224/253 |

*Primary Examiner*—Henry J. Recla
*Assistant Examiner*—David J. Walczak
*Attorney, Agent, or Firm*—Reginald F. Roberts, Jr.

[57] ABSTRACT

A versatile carrying bag useful for industrial and sporting use. The bag comprises front, rear, bottom, and side panels. The front and rear panels have exterior and interior surfaces, and upper and lower halves. The front panel and the lower half of the rear panel are substantially parallel. The upper half of the rear panel extends beyond the front panel to provide a margin which folds down over and overlaps the upper half of the front panel. Matching strips of a self-adhesive material are attached to the outer and inner surfaces of the upper halves of the front and rear panels, respectively, to provide reversible closure of the carrying bag. A pair of substantially parallel side panels are indented along their entire length. The indentations so formed are joined to the upper half of the rear panel and to the bottom panel, thereby forming an upper fold in the upper half of the rear panel, and a pair of lower folds in the bottom panel.

2 Claims, 3 Drawing Sheets

VERSATILE CARRYING BAG

BACKGROUND OF THE INVENTION

The present invention relates to carrying bags. More particularly, the invention relates to a heavy-duty, industrial-type bag particularly adapted for carrying such items as respirators, pagers, and the like.

The prior art and present market are replete with examples of carrying bags which may be employed for carrying articles. These bags, however, are not particularly well-adapted for industrial or sporting use. More importantly, the prior-art carrying bags are not easily and inexpensively manufactured.

SUMMARY OF THE INVENTION

In general, the present invention in one aspect provides a versatile carrying bag particularly adapted to industrial and sports use. The bag comprises a front panel, a rear panel, two side panels, and a bottom panel. The front, rear, and side panels have exterior and interior surfaces, and upper and lower halves. The front panel and the lower half of the rear panel are substantially parallel to one another, as are the side panels. First and second closure means are attached to the exterior and interior surfaces of the upper halves of the front and rear panels, respectively, to provide reversible closure for the carrying bag. The upper half of the rear panel is fastened to the upper half of each side panel, and overlaps the upper halves of the front and side panels when the bag is closed, thereby forming a pair of upper lateral folds in the upper half of the rear panel. The lower half of each side panel is fastened to the bottom panel, thereby forming a panel of lower lateral folds in the bottom panel.

In a second aspect, the present invention provides a method for the fabrication of a carrying bag. The method comprises the following steps:

(a) Providing a flexible sheet having first and second surfaces, upper and lower halves, upper and lower edges, and parallel lateral edges.

(b) Excising part of the lateral edges from the upper half of the sheet, and part of the lateral edges and of the lower edge from the lower half of the sheet, thereby forming an angular first pair of indentations in the upper half of the sheet, and an oblique second pair of indentations in the lower portion of the sheet.

(c) Attaching to the first surface of the lower half of the sheet near the lower edge thereof first closure means.

(d) Attaching to the second surface of the upper half of the sheet near the upper edge thereof second closure means. The first and second closure means are adapted to mate with one another upon contact.

(e) Folding the sheet to bring the first and second closure means into congruence, and to form an upper pair and a lower pair of folds in the sheet.

(f) Connecting the upper and lower folds to one another.

(g) Inverting the first and second surfaces of the sheet by turning the sheet inside-out, thereby forming a carrying bag.

In a third aspect the invention provides a carrying bag made by a particularly facile method. The method comprises the following steps:

(a) Providing a flexible sheet having first and second surfaces, upper and lower halves, upper and lower edges, and parallel lateral edges.

(b) Excising part of the lateral edges from the upper half of the sheet, and part of the lateral edges and of the lower edge from the lower half of the sheet, thereby forming an angular first pair of indentations in the upper half of the sheet, and an oblique second pair of indentations in the lower half of the sheet.

(c) Attaching to the first surface of the lower half of the sheet near the lower edge thereof first closure means.

Attaching to the second surface of the upper half of the sheet near the upper edge thereof second closure means. The first and second closure means are adapted to mate with one another upon contact.

(e) Folding the sheet to bring the first and second closure means into congruence, and to form an upper pair and a lower pair of folds in the sheet.

(f) Connecting the upper and lower folds to one another.

(g) Inverting the first and second surfaces of the sheet by turning the sheet inside-out, thereby forming a carrying bag.

DETAILED DESCRIPTION OF THE INVENTION

Figure 1:
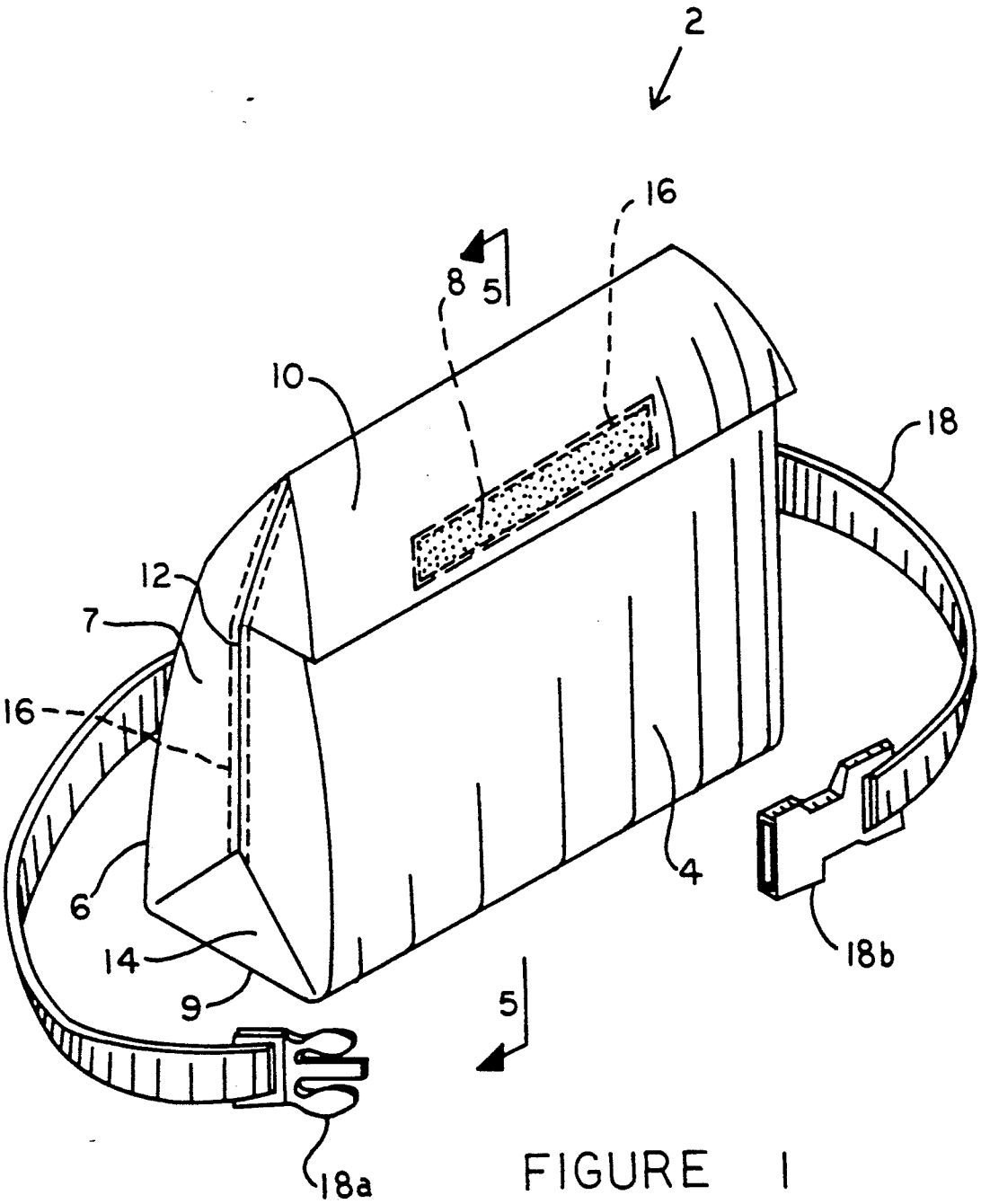
FIG. 1 is an isometric view of a filled carrying bag made in accordance with the principles of the present invention.
Figure 5:
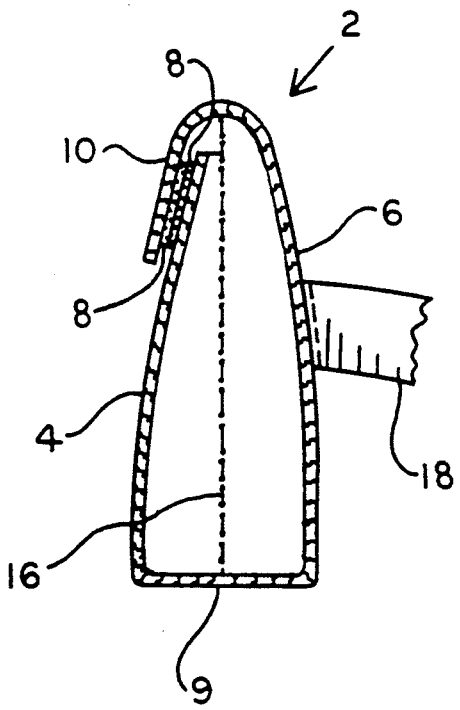
FIG. 5 is a sectional view of the carrying bag shown in FIG. 1 taken along the cutting line 5—5.

More specifically, reference is made to FIGS. 1 and 5, wherein is shown a carrying bag made in accordance with the principles of the present invention, generally designated by the numeral 2.

The carrying bag 2 comprises a front panel 4, a rear panel 6, a bottom panel 9, and a pair of substantially parallel side panels 7. The front and rear panels 4 and 6 have exterior and interior surfaces, and upper and lower halves. The upper half of the rear panel 6 extends beyond and above the front panel 4 to provide a margin 10 which folds down over and overlaps the upper half of the front panel 4. Matching strips 8 of a self-adhesive material are attached to the outer and inner surfaces of the upper halves of the front and rear panels 4, 6, respectively, to provide reversible closure of the carrying bag 2. A pair of substantially side panels 7 are indented along their entire length. The indented portions are joined to the upper portion of the rear panel 6 and to the bottom panel 9, thereby forming a pair of upper lateral folds 12 in the upper half of the rear panel, and a pair of lower lateral folds 14 in the bottom panel.

Instead of the matching strips 8 it is of course perfectly feasible to substitute fastener snaps or the like; i.e., anything which functions effectively to provide reversible closure means for the bag 2.

The upper half of the front panel 4 and/or the upper half of the rear panel 6 include/includes lateral edges which are tapered to provide easier access to the interior of the bag 2.

The carrying bag 2 is beneficially provided with a belt 18 attached to the exterior surface of the rear panel 6. The belt 18, which includes male and female parts 18*a*, 18*b* of a buckle, permits a user to carry the bag easily by wearing the belt around the user's waist or neck.

The indentation of the side panels 7, the joining of the indentations to the upper portion of the rear panel 6 and to the bottom panel 9, and the pairs of upper and lower folds 12 and 14 formed thereby are critical to the present invention. The upper and lower folds 12 and 14 are particularly critical, and the lower folds 14 are the most critical feature of all. The reason for the criticality of the upper and lower folds 12 and 14 is that they permit the bag 2 to be fabricated far more easily and efficiently than would otherwise be possible. The reason for this observation will be clear to those skilled in the art from the following disclosure, which describes a process for the manufacture of the carrying bag 2.

Preferably, the side panels are stitched to the rear and bottom panels.

Even more preferably, the side panels are formed by fastening the front and rear panels to one another along a pair of substantially parallel lines extending from opposite ends of the bottom panel to the upper half of the rear panel and approximately bisecting the side panels.

Even more preferably, the tapered lateral edges of the rear panel are fastened to the side panels.

Most preferably, the tapered lateral edges of the rear panel are stitched to the side panels.

Figure 2:
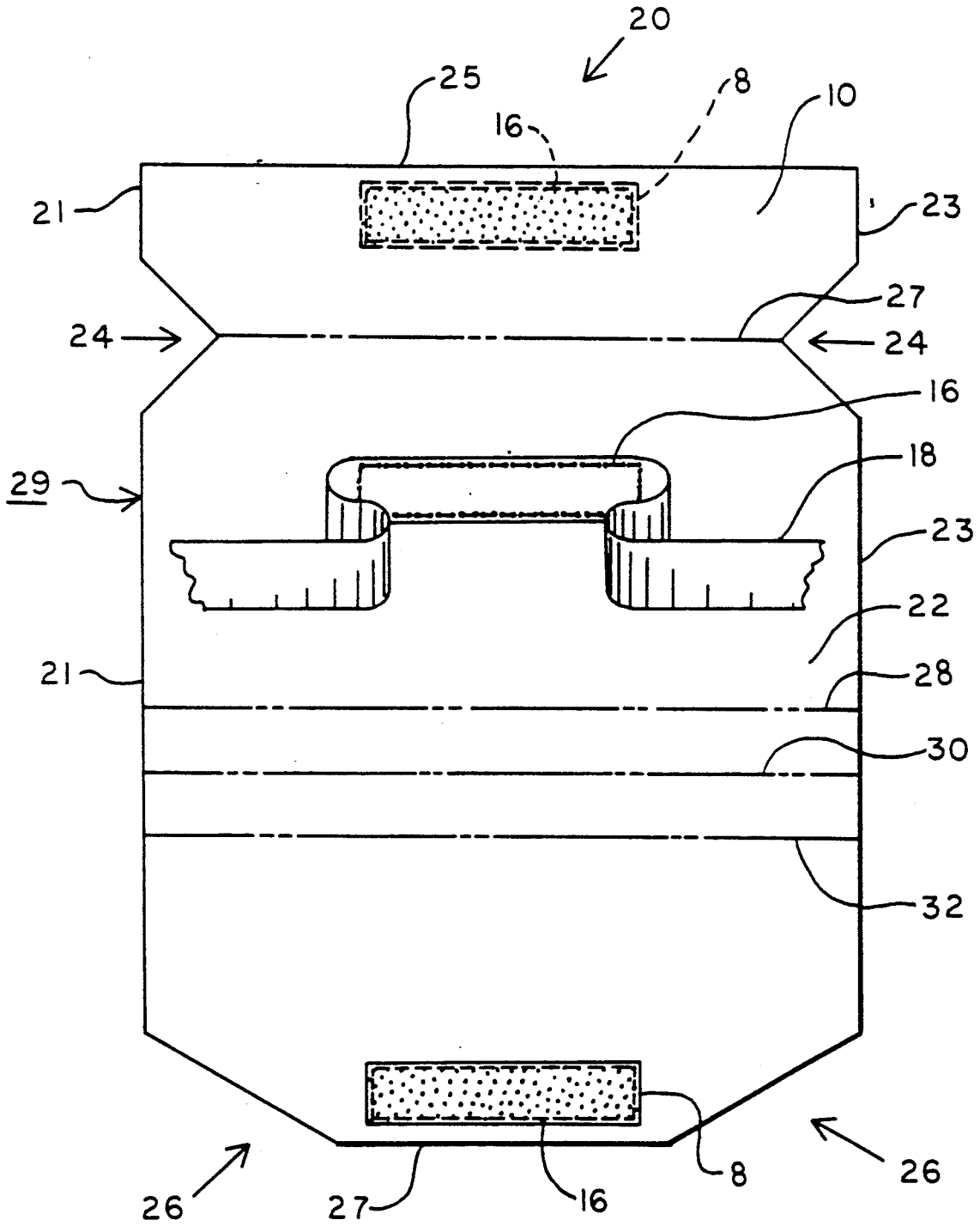
FIG. 2 is top plan view of a sheet to be used for the fabrication of a carrying bag made in accordance with the principles of the present invention.
Figure 3:
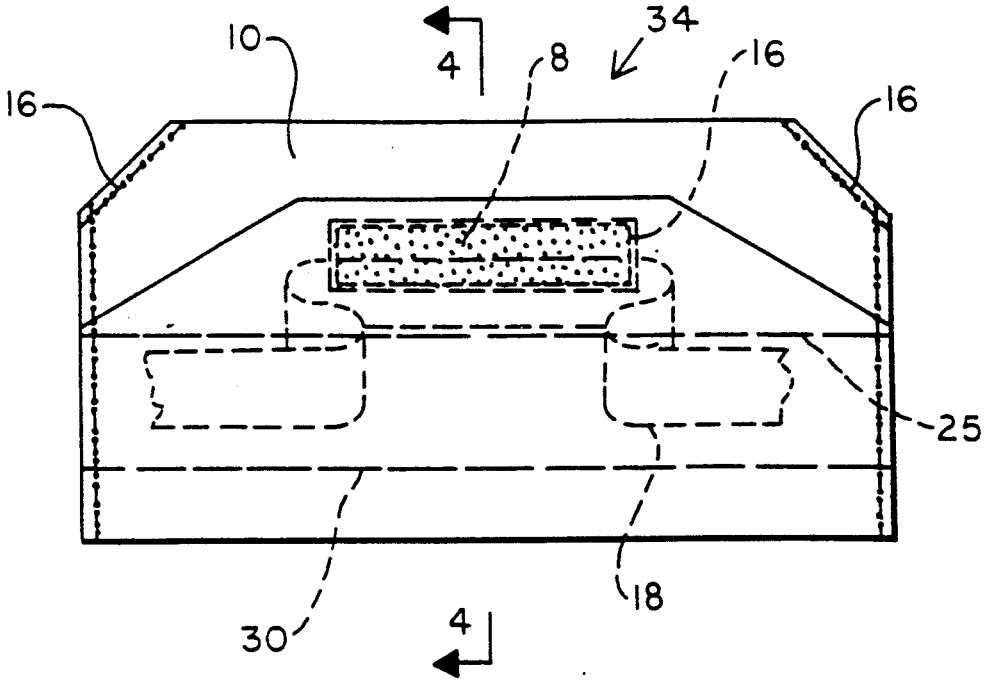
FIG. 3 is a top plan view of the same sheet after being folded.
Figure 4:
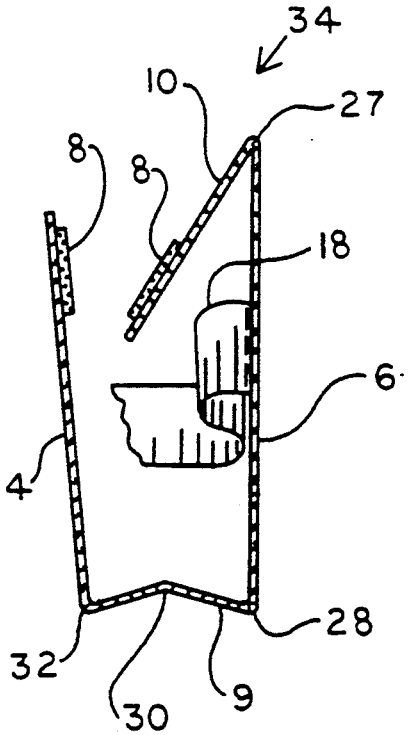
FIG. 4 is a sectional view of the sheet shown in FIG. 3 taken along the cutting line 4—4.

For a detailed description of the method used to fabricate the bag 2, reference is made to FIGS. 2–4, wherein are shown the several steps required, and to FIG. 5, wherein is shown the finished article 2. It is to be understood that the first three steps of the method need not be carried out in the order described.

Referring now to FIG. 2, there is shown a single sheet 29 made of a flexible material, having first and second opposite surfaces, and to which are attached a belt 18 and matching strips 8 of a self-adhesive material, the ensemble being generally designated by the numeral 20.

The first step in the preparation of the bag 2 is cutting away or otherwise removing part of the lateral edges 21, 23 from the upper half 10 of the sheet 29, part of the lateral edges 21, 23, and part of the lower edge 27 from the lower half 22 of the sheet 29. The result of this operation is to form an angular first pair of indentations 24 in the upper and lower halves 10, 22 of the sheet 29, and an oblique second pair of indentations 26 in the lower edge 27 of the lower half 22 of the sheet 29.

The second step is to attach to the first surface of the lower half 22 of the sheet 29 near its lower edge 27 a first strip 8 having inner and outer surfaces. The outer surface of the first strip 8 is formed of a self-adhesive material. The inner surface of the strip 8 is attached to the first surface of the sheet 29.

The third step is to attach to the second surface of the upper half 10 of the sheet 29 a second strip 8 having inner and outer surfaces. The outer surface of the second strip 8 is formed of a self-adhesive material. The inner surface of the second strip 8 is attached to the second surface of the sheet 29. The outer surfaces of the first and second strips 8 are adapted to adhere to one another upon contact.

A belt 18 with a buckle 18*a*, 18*b* is beneficially attached at this time to the first surface of the lower half 22 of the sheet 29. The belt 18 provides support means for the carrying bag 2 when for example worn about a user's waist.

The sheet 29 is then folded along the fold lines 27, 28, 30, and 32, and stitched 16 shown to form the configuration shown as 34 in FIGS. 3 and 4. The upper and lower folds 12 and 14 are stitched to one another along a pair of substantially parallel lines 16 extending from opposite ends of the bottom panel 9 to the upper half of the rear panel 6. The parallel lines 16 approximately bisect the side panels 7.

It is to be understood that, in lieu of the matching strips 8, first and second closure means such as snap fasteners may be used and would function in an equivalent manner. It is to be further understood that, instead of stitching, any equivalent connecting means may be used.

The final step is to invert the configuration 34 by turning it inside-out to obtain the carrying bag 2 shown in FIGS. 1 and 5.

The self-adhesive material of the first and second strips 8 is preferably VELCRO TM, a product made and sold by VELCRO, USA, Inc., Manchester, N,H., under the trademark "VELCRO."

The flexible material of which the sheet 29 and carrying bag 2 are made is preferably natural or synthetic polymers or resins; e.g., polyvinyl resins ("vinyl").

I claim:

1. A method for the fabrication of a carrying bag, the method comprising the steps of:

(a) providing a flexible sheet having first and second surfaces, upper and lower halves, upper and lower edges, and parallel lateral edges;

(b) excising part of the sheet adjacent the lateral edges from the upper half of the sheet, and the corners of the sheet of the lower edge of the sheet, thereby forming a pair of triangular indentations in the upper half of the sheet, and a pair of oblique corners in the lower half of the sheet;

(c) attaching to the first surface of the lower half of the sheet near the lower edge thereof first reversible closure means;

(d) attaching to the second surface of the upper half of the sheet near the upper edge thereof second reversible closure means, the first and second closure means being adapted to mate reversibly with one another upon contact;

(e) folding the sheet to bring the first and second closure means together and edges of said indentations and corners into alignment, and to form an upper fold extending between the apex of each triangular indentation and a lower pair of folds sandwiching an intermediate fold in the sheet, and to bring the lower pair of folds opposite said upper fold;

(f) connecting all overlapping edges of each lateral edge together from each of the lower folds to the upper fold;

(g) separating the first and second reversible closure means; and (h) inverting the first and second surfaces of the sheet by turning the sheet inside-out, thereby forming a carrying bag.

2. A carrying bag made by a method comprising the steps of:

(a) providing a flexible sheet having first and second surfaces, upper and lower halves, upper and lower edges, and parallel lateral edges;

(b) excising part of the sheet adjacent the lateral edges from the upper half of the sheet, and the corners of the sheet at the lower edge of the sheet, thereby forming a pair of triangular indentations in the upper half of the sheet, and a pair of oblique corners in the lower half of the sheet;

(c) attaching to the first surface of the lower half of the sheet near the lower edge thereof first reversible closure means;

(d) attaching to the second surface of the upper half of the sheet near the upper edge thereof second reversible closure means, the first and second closure means being adapted to mate reversibly with one another upon contact;

(e) folding the sheet to bring the first and second closure means together and said edges of said indentations and corners into alignment, and to form an upper fold extending between the apex of each triangular indentation and a lower pair of folds sandwiching an intermediate fold in the sheet, and to bring the lower pair of folds opposite said upper fold;

(f) connecting all overlapping edges of each lateral edge together from each of the lower folds to the upper fold;

(g) separating the first and second reversible closure means; and (h) inverting the first and second surfaces of the sheet by turning the sheet inside-out, thereby forming a carrying bag.

* * * * *